US006305570B1

(12) United States Patent
Atkin et al.

(10) Patent No.: US 6,305,570 B1
(45) Date of Patent: Oct. 23, 2001

(54) CLOSURE ASSEMBLY FOR A DRINKING VESSEL

(75) Inventors: Edward Atkin, London; Roger Leonard Williams, Hertfordshire, both of (GB)

(73) Assignee: Cannon Rubber Limited, A British Company, London (GB)

( * ) Notice: Subject to any disclaimer, the term of this patent is extended or adjusted under 35 U.S.C. 154(b) by 0 days.

(21) Appl. No.: 09/601,229

(22) PCT Filed: Jan. 29, 1999

(86) PCT No.: PCT/GB99/00312

§ 371 Date: Sep. 27, 2000

§ 102(e) Date: Sep. 27, 2000

(87) PCT Pub. No.: WO99/38423

PCT Pub. Date: Aug. 5, 1999

(30) Foreign Application Priority Data

Jan. 30, 1998 (GB) ..... 9802095

(51) Int. Cl.[7] ..... A47G 19/22

(52) U.S. Cl. ..... 220/714; 220/717; 215/11.4

(58) Field of Search ..... 220/714, 713, 220/716, 717, 365, 366.1, 367, 303, 750; 215/11.4, 11.5, 388, 17, 18; 222/482, 490, 494, 559, 561, 705, 703, 711, 714, 528, 529, DIG. 7

(56) References Cited

U.S. PATENT DOCUMENTS

| | | | | |
|---|---|---|---|---|
| Re. 37,016 | * | 1/2001 | Morano | 220/714 |
| 2,107,442 | | 2/1938 | Hughes . | |
| 5,706,973 | * | 1/1998 | Robbins, III et al. | 220/714 |
| 5,890,620 | * | 4/1999 | Belcastro | 220/714 |
| 6,102,245 | * | 8/2000 | Haberman | 220/714 |

FOREIGN PATENT DOCUMENTS

| | | |
|---|---|---|
| 29706653 | 7/1997 | (DE) . |
| 0575014 | 12/1993 | (EP) . |
| 2266045 | 10/1993 | (GB) . |

OTHER PUBLICATIONS

PCT International Search Report, mailed on Jun. 10, 1999, in connection with International Application No. PCT/GB99/00312.

United Kingdom Search Report, dated Apr. 6, 1999, in connection with GB Application No. 9902102.4.

* cited by examiner

*Primary Examiner*—Stephen P. Garbe
*Assistant Examiner*—Lien Ngo
(74) *Attorney, Agent, or Firm*—H. T. Than Law Group

(57) ABSTRACT

A closure assembly for a drinking vessel comprising a lid (2) with a spout (3). A diaphragm valve (14) is mounted on a central spigot (7) of an insert which protrudes from the bottom of the spout (3) and has an enlarged head (8) which provides a sealing surface (9) which cooperates with a bead (16) around a central hole (22) in the diaphragm. The diaphragm (14) has an annular flap (18) at its periphery which normally closes a breather hole (4) in the lid (2) but opens when a user sucks on the spout (3) to allow air to enter container (1) to equalize the internal and external pressure when liquid flows past the diaphragm (14).

24 Claims, 5 Drawing Sheets

CLOSURE ASSEMBLY FOR A DRINKING VESSEL

This invention relates to a closure assembly for drinking vessels and more particularly to a closure assembly which can be fitted to a trainer cup, feeding bottle or like container.

Trainer cups are well known and comprise a cup or mug provided with a lid having a mouthpiece thereon, usually in the form of a spout. They are generally used by young infants or toddlers after they have given up using a feeding bottle but they are not yet old enough to hold a normal cup or glass and will often tip it too far. As the child is still very young, it is not unusual for the trainer cup to be inadvertently knocked over or for the child to invert it so that the liquid contained therein leaks out. Infants also shake trainer cups up and down which again generally results in the liquid leaking out of the cup.

There is therefore a need for a closure assembly for a drinking vessel such as a trainer cup which is leakproof in that it will prevent liquid contained therein from being removed from the vessel should it be inverted or shaken. However, the liquid must be able to be dispensed from the vessel when the child sucks on the spout so some form of valving arrangement needs to be incorporated into the lid to enable this to be done. Known valve systems tend to be rather complicated and therefore expensive to manufacture and sometimes difficult to use. Due to their complexity, they can also be troublesome to clean.

It is therefore an object of the present invention to provide a leakproof closure assembly for a drinking vessel which only allows liquid to be removed from the vessel when the user sucks on the outlet thereto. It is a further object of the invention to provide a closure assembly for a drinking vessel which includes valve means associated with its outlet which are normally closed to prevent the passage of liquid past the valve means thereby ensuring that liquid in the vessel does not leak out should the vessel be inverted, dropped or shaken up and down, the valve means opening only when a user sucks on the outlet.

According to one aspect of the invention there is provided a closure assembly for fitting to an open ended drinking vessel comprising a lid with a drinking spout extending therefrom through which liquid can flow when a user sucks on said spout, a flexible resilient diaphragm retained by mounting means on the lid to normally prevent liquid flow through the spout, said diaphragm having a primary sealing portion which cooperates with a seat to make a fluidtight seal therewith, the diaphragm also having a secondary sealing portion which normally cooperates with a breather hole to make a fluidtight seal therewith, the arrangement being such that when a user sucks on the spout, the primary sealing surface is deflected away from the seat to permit liquid flow and the secondary sealing portion no longer makes a fluidtight seal with the breather hole so air can pass therethrough to equalise the pressure across the diaphragm.

Preferably, the diaphragm has an aperture in the centre thereof, the primary sealing portion comprising an annular bead which extends around said aperture on one face of the diaphragm.

Preferably, mounting means for the diaphragm are provided adjacent the entrance to the spout. The mounting means can be provided on a separate insert or moulded as part of the lid. Conveniently the mounting means comprises a post protruding from the entrance to the spout and the seat is an annular surface thereon. In one embodiment, the post has an enlarged head with an undercut surface thereon which provides said annular seat.

In an alternative embodiment, the diaphragm has a central pillar extending therefrom with an enlarged head at its free end having the primary sealing portion thereon which engages the seat on the closure assembly, the diaphragm having at least one hole therein for the passage of liquid therethrough. Preferably, the primary sealing portion is an annular bead which extends from the enlarged head towards the diaphragm. This diaphragm is fitted to a closure assembly in which the spout has an entrance which is closed by a wall with an aperture therein, said aperture acting as the mounting means which receives the enlarged head of the diaphragm so that the annular bead thereon contacts said wall to make a fluidtight seal therewith. In this embodiment, the central pillar is longer than the thickness of the wall so that the body of the diaphragm is spaced therefrom but can move axially relative to the hole when a negative pressure is applied thereto to lift the annular bead from the wall and allow fluid flow.

Preferably the diaphragm has an upstanding annular lip or wall around its outer periphery with a flap extending laterally outwardly therefrom.

In one embodiment, the breather hole is provided in the lid and is normally closed by the laterally extending flap on the diaphragm. However, in another embodiment, the breather hole is provided in an insert fitted in the spout which has the mounting means thereon for the diaphragm.

The diaphragm is preferably configured so that when it is fitted to the closure, it adopts a concave configuration and its outer periphery is biased into contact with the closure assembly.

The post can be a push fit in the spout and it can include gripping means to assist in its removal therefrom. Alternatively, the post can be moulded as an integral part of the lid.

The diaphragm can be moulded from any suitable natural or synthetic material but preferably it is moulded from silicone rubber.

In another embodiment, the mounting means and breather hole are provided on a separate insert fitted into the open end of the spout. Conveniently, the insert has at least one hole therein to allow the passage of liquid therethrough. The breather hole can be provided on the lid and/or the insert.

The mounting means preferably comprises a post extending from the insert having an enlarged head with an undercut surface which provides the seat to cooperate with the primary sealing portion of the diaphragm.

The insert can have an upstanding projection thereon with a breather hole therethrough, said projection being adapted to locate in a corresponding hole in the lid It also preferably has means thereon for releasably attaching it to the closure assembly.

To enable the diaphragm to be reversible, it can have a second upstanding lip or wall with an annular flap extending laterally therefrom provided around its periphery, said second wall and flap being a mirror image of said first wall and flap to provide a double sided diaphragm which is H-shaped in cross section.

It will be appreciated from the foregoing that the present invention provides a closure assembly for a drinking vessel which includes a resilient flexible diaphragm, preferably with a centrally located sealing portion normally biased into contact with a seat to prevent the flow of fluid from the vessel between the diaphragm and the seat, the diaphragm being deflectable away from the seat in response to the application of a negative pressure thereto which is sufficient to overcome said bias and allow liquid to flow past the diaphragm and the seat and out of the vessel.

Preferred embodiments of the invention will now be described, by way of example only, with reference to the accompanying drawings, in which.

Figure 1:
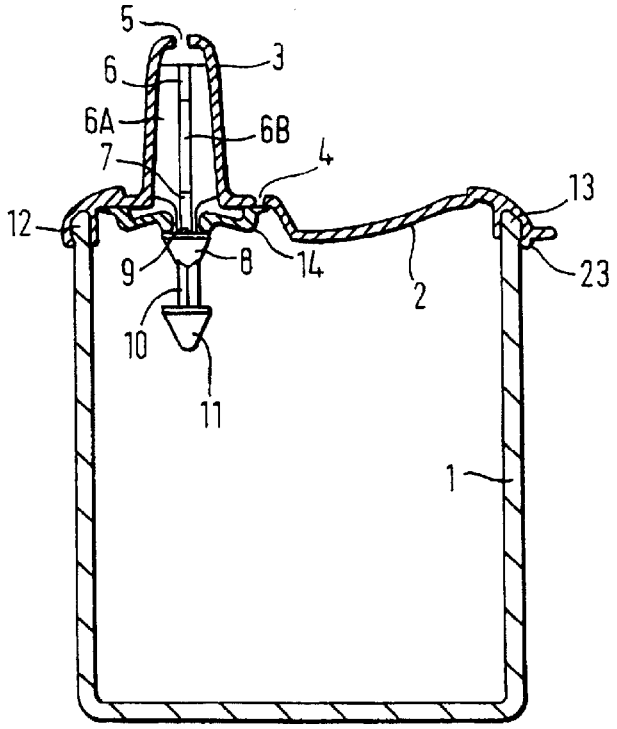
FIG. 1 is a cross section of a first embodiment of the invention showing the closure assembly fitted to a drinking vessel with the diaphragm valve in its normal closed condition.
Figure 2:
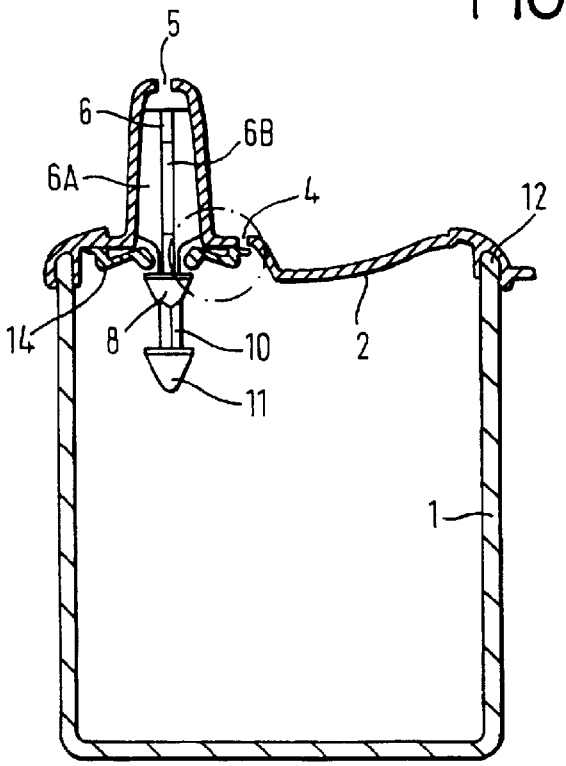
FIG. 2 is a view identical to that shown in FIG. 1 but illustrating the diaphragm valve in its open condition.
Figure 3:
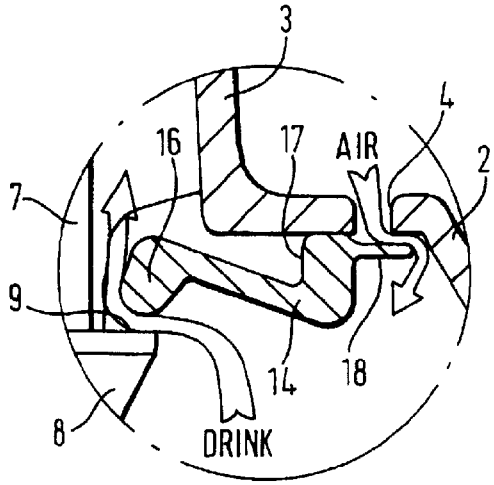
FIG. 3 is a scrap view of the part of the valve circled in FIG. 2.

Referring to the drawings and particularly FIGS. 1–3, there is shown a closure assembly of the invention which comprises lid 2 which is fitted to a drinking vessel 1 of known type. The underside of the periphery of the lid 2 is formed with an annular recess 12 having an inwardly directed bead 13. The upper edge of the drinking vessel 1 has an annular bead 23 around its periphery which is received in the recess 12 in the lid and retained therein due to the bead 13 on the lid engaging underneath the bead 23 on the container.

The lid 2 has a drinking outlet in the form of a spout 3 moulded thereon having an aperture 5 through which liquid can flow. A breather hole 4 is provided in the lid 2 adjacent the spout 3 for reasons which will be explained hereafter.

In this embodiment, mounting means in the form of a separate insert 6 is fitted inside the spout and makes a friction fit therewith. In the illustrated embodiment, the insert 6 comprises a pair of webs 6A and 6B which are fitted together to form a cruciform and have tapered outer edges following the configuration of the inside surface of the spout 3 to enable the insert 6 to be press fitted into the spout and retained therein.

The bottom of the insert 6 has a post or spigot 7 extending therefrom with an enlarged head 8 at its free end. In the illustrated arrangement, four webs 10 are formed on the spigot at 90° to each other and the enlarged head 8 is conical in configuration with an upper surface which provides an annular sealing surface or seat 9 for cooperation with diaphragm 14 in a manner to be described shortly. A second enlarged head 11 is fitted on the end of post 7 to provide means which can be gripped by the user to pull the insert 6 out of the spout 3 for cleaning purposes.

Figure 7:
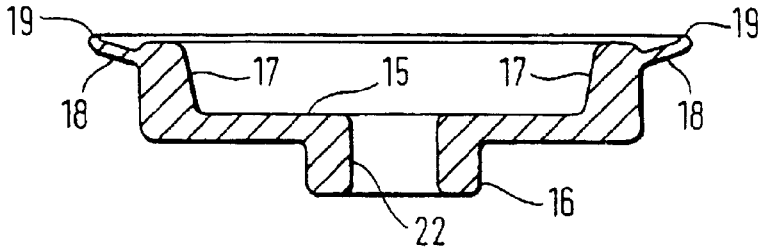
FIG. 7 is a cross section through the diaphragm shown in FIGS. 1–3 and 6.
Figure 8:
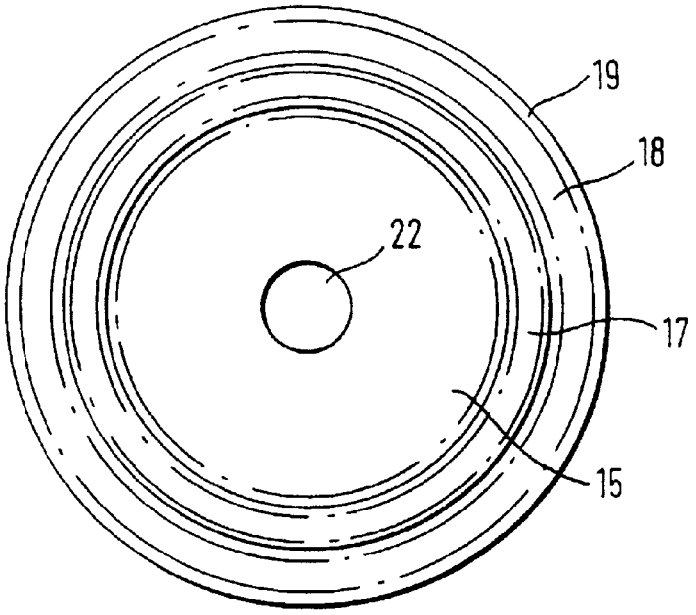
FIG. 8 is a plan view of the diaphragm shown in FIG. 7.

Referring now to FIGS. 7 and 8, there is shown the diaphragm 14 of the present invention which is illustrated in FIGS. 1 to 3. The illustrated diaphragm is moulded in one-piece from silicone rubber although other materials could be used and it comprises a body 15 with a central hole 22 formed therein having a primary sealing portion in the form of an annular bead 16 around its periphery. An annular wall 17 is formed round the outer edge of the body 15 and the upper edge of the wall 17 has a secondary sealing portion in the form of an outwardly extending annular lateral flap 18 formed thereon. As can be seen from FIG. 7, this flap 18 is slightly upwardly directed for reasons which will be explained later in the specification and the peripheral edge of the flap 18 has an annular bead 19 moulded thereon.

Referring again to FIGS. 1 to 3, it can be seen that the diaphragm 14 is mounted on the insert 6 with the post 7 extending through the central hole 22 therein (see FIGS. 7 and 8). Because of the webs 10 on the spigot 7, it fits in the central hole 22 leaving gaps between the webs through which liquid can flow when the bead 16 around the central hole lifts away from the annular sealing face 9 on the enlarged head 8. The cruciform configuration of the spigot 7 is only preferred It will be appreciated that the spigot can have any suitable cross section. It could for instance be square or T-shaped provided that when the diaphragm is fitted on it, a gap or gaps are left around it for the passage of fluid through the central aperture 22. Due to the resilience of the diaphragm 14, the central hole 22 can be stretched over the enlarged heads 11 and 8 to allow the diaphragm to be pushed into its normal rest position shown in FIG. 1 where the annular lip 18 rests against the under surface of the lid 2 and covers the breather hole 4. Due to the upward inclination of the flap 18 and the fact that the annular bead 19 is higher than the annular wall 17 of the diaphragm, the bead 18 makes an airtight seal with the undersurface of the lid 2 to normally prevent the passage of air through the breather hole 4. It should also be noted that the distance between the underside of the lid 2 and the sealing surface or seat 9 on the enlarged head 8 is less than the thickness of the diaphragm 14 thereby ensuing that when the diaphragm 14 is fitted to the post 7, its central portion is deflected upwardly as illustrated to bias it into sealing engagement with the lid 2.

It will be seen from the foregoing that when the diaphragm is in its normal rest position shown in FIG. 1, if the container 1 with the lid 2 fitted thereto is inverted, liquid cannot leak out of the container 1 past the diaphragm 14 and through the spout 3 because the breather hole 4 is closed by the secondary portion 18 of the diaphragm and the bead 16 which provides the primary sealing portion around the central aperture in the diaphragm is biased into engagement with the seat 9.

However, when an infant applies a negative pressure to the spout 3 by sucking on it, the diaphragm 14 is distorted to the configuration shown in FIG. 3 and the annular bead 16 around the central hole 22 lifts off the seat 9 on the enlarged head 8 and liquid flows past the annular bead 16 and seat 9 into the spout 3. As the liquid is evacuated, the pressure reduces in the drinking vessel and the outwardly extending flap 18 around the peripheral edge of the diaphragm 14 covering the breather hole 4 moves away from the undersurface of the lid 2 to leave a space therebetween through which external air can pass under the influence of atmosphere pressure thus equalising the internal and external pressures. Once the infant stops applying the negative pressure to the spout 3, the diaphragm 14 returns to its rest position shown in FIG. 1 and the breather hole 4 is again closed off by the lateral flap 18 on the diaphragm 14.

Figure 4:
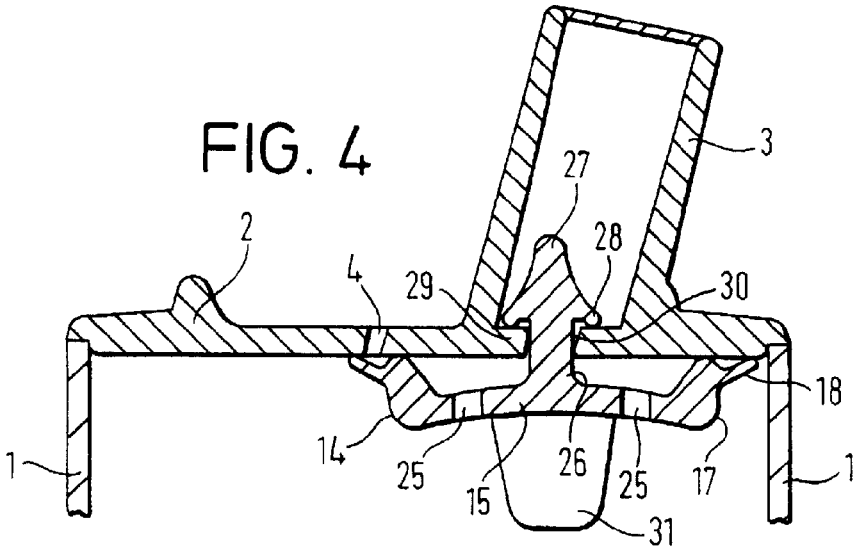
FIG. 4 is a cross section through an alternative closure assembly of the invention.

Referring now to FIG. 4, there is shown an alternative embodiment to that shown in FIGS. 1 to 3 in which the diaphragm 14 is mounted directly to the lid 2.

In the embodiment shown in FIG. 4, the lid 2 has a spout which has a wall 29 extending across it with an opening 30 therein. The lid 2 also has a breather hole 4 extending therethrough.

The diaphragm 14 comprises a central body portion 15 with an annular upstanding wall 17 around its peripheral edge from which a secondary sealing portion in the form of annular flap 18 extends laterally and slightly upwardly. One or more holes 25 are formed in the body 15 of the diaphragm to allow the passage of liquid therethrough and an optional tab 31 is also moulded on the undersurface of the central portion 15 to facilitate the removal of the diaphragm 14 from the hole 30 in the lid 2. This hole provides the mounting means for the diaphragm 14 in the lid 2.

A spigot 26 extends upwardly from the centre of the diaphragm 14 and has an enlarged head 27 thereon which includes an annular bead 28 around its wider bottom periphery which provides the primary sealing portion to sealingly engage with the upper surface of the bottom wall 29. The length of the spigot 26 is such that when the diaphragm 14 is mounted in position in the lid 2, the body 15 assumes the illustrated concaved configuration thereby ensuring that the upper edge of the annular wall 17 is biased into contact with the undersurface of the lid 2 and similarly the free end of the upwardly inclined lateral flap 18 is biased into contact with the undersurface of the lid 2 to close the hole 4 in the lid 2.

It will be seen from the foregoing description of the embodiment shown in FIG. 4 that when an infant sucks on the spout 3, a negative pressure is created in the spout which lifts the enlarged head 27 off the upper surface of the bottom wall 29 thereby allowing liquid from the container 1 to flow through the holes 25 in the diaphragm 14, the central hole 30 and into the spout 3. At the same time, the body 15 of the diaphragm distorts and, as the liquid flows from the container 1, a negative pressure is generated in the container 1 causing the laterally extending flap 18 to be drawn away from the undersurface of the lid 2 thereby allowing air to pass into the container 1 through the hole 4 until such time as the negative pressure in the spout 3 is released when the baby or infant stops sucking on it. Once this happens the diaphragm reverts to its normal closed configuration.

Figure 5:
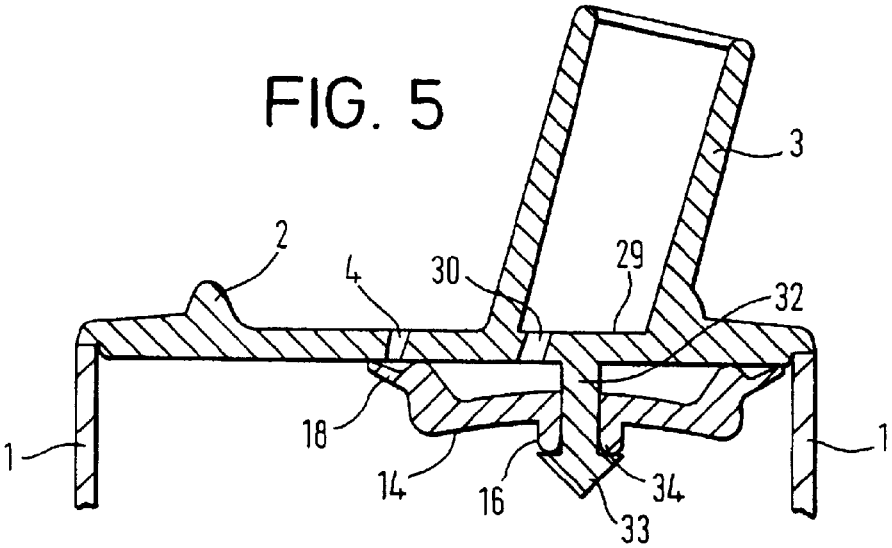
FIG. 5 is a cross section through a still further alternative embodiment of the present invention.

FIG. 5 shows a still further embodiment in which the diaphragm 14 is mounted on a spigot 32 having an enlarged head 33. The spigot 32 is moulded as an integral part of the lid 2 and is attached to and extends from the undersurface thereof. As with the embodiment shown in FIG. 4, a breather hole 4 is formed in the lid 2 adjacent the spout 3 which has a bottom wall 29 with an aperture 30 extending therethrough. It will be seen therefore that when a negative pressure is applied by an infant sucking on the spout 3, the bead 16 around the central hole 22 in the diaphragm will lift off annular seat 34 provided on the enlarged head 33 so liquid can flow from the container 1 past the diaphragm valve 14 and into the spout 3 through the hole 30. At the same time, due to the reduced pressure created in the container, the laterally extending flap 18 will move away from the undersurface of the lid 2 to allow air to pass through the breather hole 4. This will continue until the negative pressure applied to the spout 3 terminates when the baby stops sucking on it.

Figure 6:
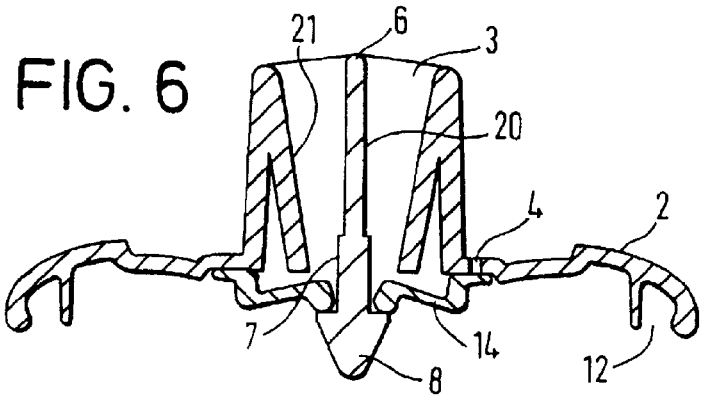
FIG. 6 is a cross section through yet another embodiment of the invention.

The embodiment shown in FIG. 6 is similar to that shown in FIGS. 1–6 except that the removable insert 6 on which the diaphragm 14 is mounted is moulded integrally with the spout 3. It can be seen that the inside surface of the spout 3 is formed with a conical inner surface 21 and a wall 20 extends across the spout 3 and is moulded integrally therewith. The bottom of the wall 20 is formed with the post 7 and enlarged head 8 as before. The diaphragm 14 is mounted on the post 7 in exactly the same way as already described with reference to FIGS. 1–3 and the valve operates in exactly the same way as has already been described with reference to FIGS. 1–3.

Figure 9:
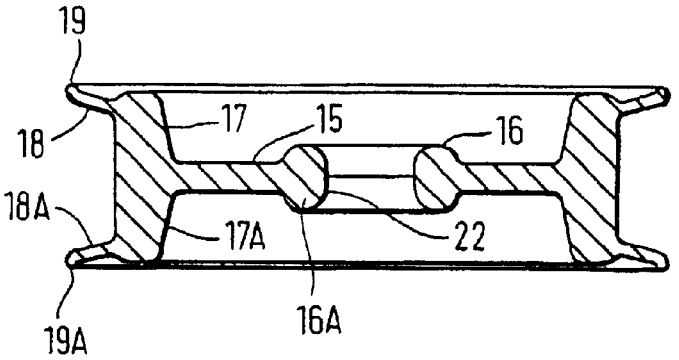
FIG. 9 is a cross section through an alternative configuration of diaphragm which is reversible.

One problem with the embodiments shown in FIGS. 1–3 and FIG. 6 is that it is possible for the user to assemble the diaphragm on the post 7 upside down in which case the diaphragm will not work because the bead 16 around its central aperture will not be in contact with the sealing surface 9 and the annular sealing flap 18 will no longer be able to contact the undersurface of the lid 2 so it cannot seal breather hole 4. To overcome this problem it is possible to modify the configuration of the diaphragm shown in FIG. 7 to provide a mirror image thereof thereby making it double sided and ensuring that it does not matter which way the diaphragm is fitted on the post 7. As can be seen from FIG. 9, the double-sided diaphragm 14 comprises a body 15 with a central hole 22 therein having an annular bead 16 around the upper surface of central hole 22 and another annular bead 16A around its lower surface. The upstanding annular wall 17 with its outwardly extending flap 18 and bead 19 is repeated on the lower surface of the diaphragm to provide second annular wall section 17A, outwardly extending annular flap 18A and annular bead 19A thereon. As can be seen from the drawing, this provides a diaphragm which is of generally H-cross section. As the configuration is uniform, it does not matter which way the diaphragm is fitted to the post 7 as one of the annular beads 16,16A will always be in contact with the seat 9 and the flap 18 and bead 19 will always cover the air hole 4.

Figure 10:
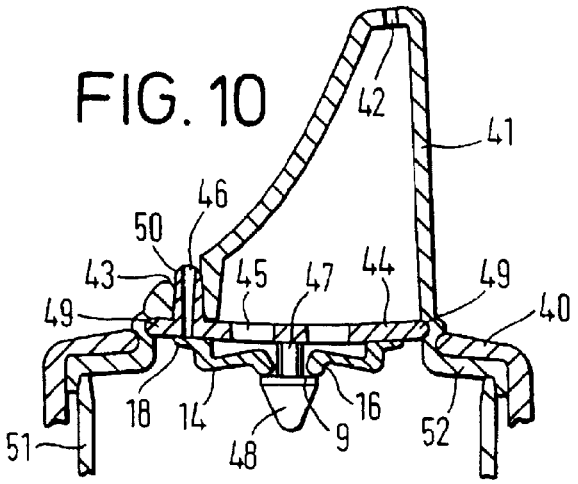
FIG. 10 is a cross section through a further embodiment.
Figure 11:
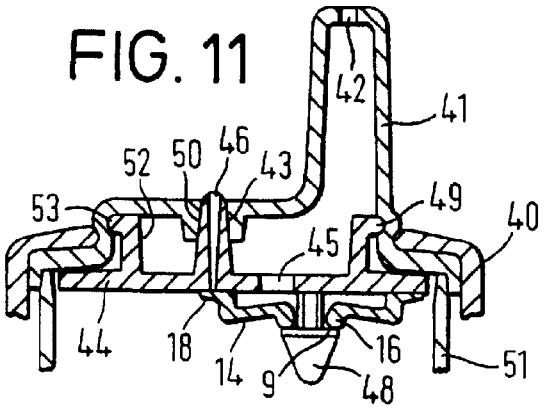
FIG. 11 is a cross section through yet another embodiment.
Figure 12:
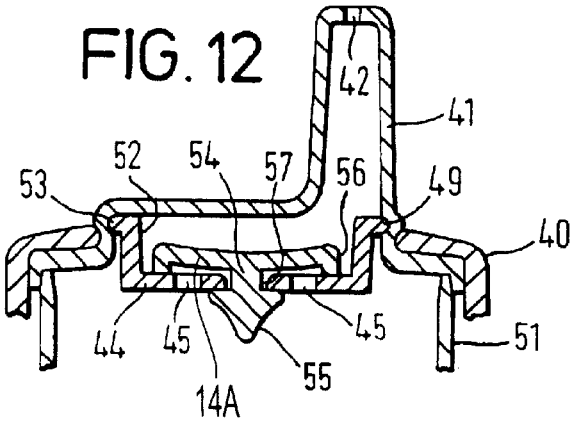
FIG. 12 is a cross section through a still further embodiment.

Referring now to FIGS. 10–12, there are shown three further embodiments of the invention in which a drinking spout 41 is releasably attached to neck 51 of a drinking vessel (not shown) such as a feeding bottle by means of screwcap 40 which has internal threads which engage with external threds (not shown) on neck 51.

The screwcap 40 has a central aperture therein through which the spout 41 protrudes. The screwcap 40 engages with a flange 52 extending laterally from the mouthpiece 41 and sandwiches it between the undersurface of the screwcap 40 and the upper rim of the neck 51. An annular rebate 49 is provided around the internal face of the mouthpiece 41 adjacent its base for reasons to be explained shortly. The mouthpiece 41 has hole 43 adjacent its base and an aperture 42 at its other end through which liquid can be dispensed when a user sucks on the mouth piece.

A rigid moulded plastics closure or insert 44 is removably mounted in the base of the mouthpiece 41 due to the engagement of its periphery in the annular rebate 49. The insert 44 has one or more apertures 45 extending through it and includes an upstanding projection 50 with a breather hole 46 therethrough When the insert 44 is mounted in position in the mouthpiece 41, the projection 50 fits into the hole 43 in the mouthpiece 41. The insert 44 has a spigot 47 extending centrally therefrom with an enlarged head 48 at its free end. A diaphragm 14 the same as that shown in FIGS. 1–3 is mounted on the spigot 47 in the same manner as has already been described with reference to the embodiment of FIGS. 1 to 3 so that it assumes the illustrated concave configuration in which the annular rib 16 is normally biased into sealing engagement with seat 9 on the enlarged head 48 and flap 18 sealingly covers breather hole 46. It also operates in the same way as the FIGS. 1–3 valve in that when a user sucks on the mouthpiece 41, the annular rib 16 around the central hole 22 in the diaphragm 14 lifts away from the seat 9 on the enlarged head 48 to allow liquid to flow from the container through the apertures 45 and out of the mouthpiece 41 through opening 42. At the same time, the flap 18 at the periphery of the diaphragm 14 is deflected away from the breather hole 46 and air from the exterior of the vessel flows through the duct 46 into the interior of the vessel (not shown) to equalise the internal and external pressure.

The embodiment shown in FIG. 11 is very similar to that shown in FIG. 10 except that the hole 43 is more centrally located in the mouthpiece 41. The insert 44 is also of a slightly different configuration in that it has an upstanding annular wall 52 with a bead 53 extending outwardly from its upper edge which fits into the annular recess 49 in the mouthpiece 41 to retain the insert 44 therein. As with the FIG. 10 embodiment, the upstanding projection 50 with breather hole 46 extending through it fits into the hole 43 in the mouthpiece 41. It will be appreciated that the diaphragm 14 operates in exactly the same way as has just been described with reference to FIG. 10 when a user sucks on the mouthpiece 41.

The embodiment shown in FIG. 12 is different from those shown in FIGS. 10 and 11 in that the mouthpiece 41 does not have a breather hole in it. The insert 44 has an upstanding annular wall 52 at its peripheral edge with an outwardly extending bead 53 extending from its upper edge which engages in the annular rebate 49 in the mouthpiece 41 to retain the insert 44 therein. The insert 44 is provided with one or more apertures 45 to allow liquid to flow from the container past the diaphragm valve 14A and out of the mouthpiece 41 through the outlet aperture 42. The diaphragm 14A is of a different configuration to any of the diaphragms shown in FIGS. 1–11 in that it has an upstanding central pillar 54 with an enlarged head 53 at one end thereof. A downwardly depending annular lip 56 is provided around the periphery of the diaphragm 14A. A central hole 57 is formed in the insert 44 to receive the central pillar 54 of the diaphragm 14A and it can be seen that the enlarged head 55 can be pushed through the aperture 57 to retain the diaphragm 14A in the insert 44. Due to the relationship between the length of the pillar 54 and the depth of the annular lip 56, the diaphragm assumes the illustrated concave configuration when in position in the insert 44 and the free edge of the lip 56 is normally biased to make a fluidtight seal with the upper surface of the insert 44.

When a user sucks on the mouthpiece 41, the peripheral edge 56 of the diaphragm 14A is lifted away from the insert so liquid can flow from the container through the aperture 45 and out of the mouthpiece 41 through the outlet 42.

Figure 13:
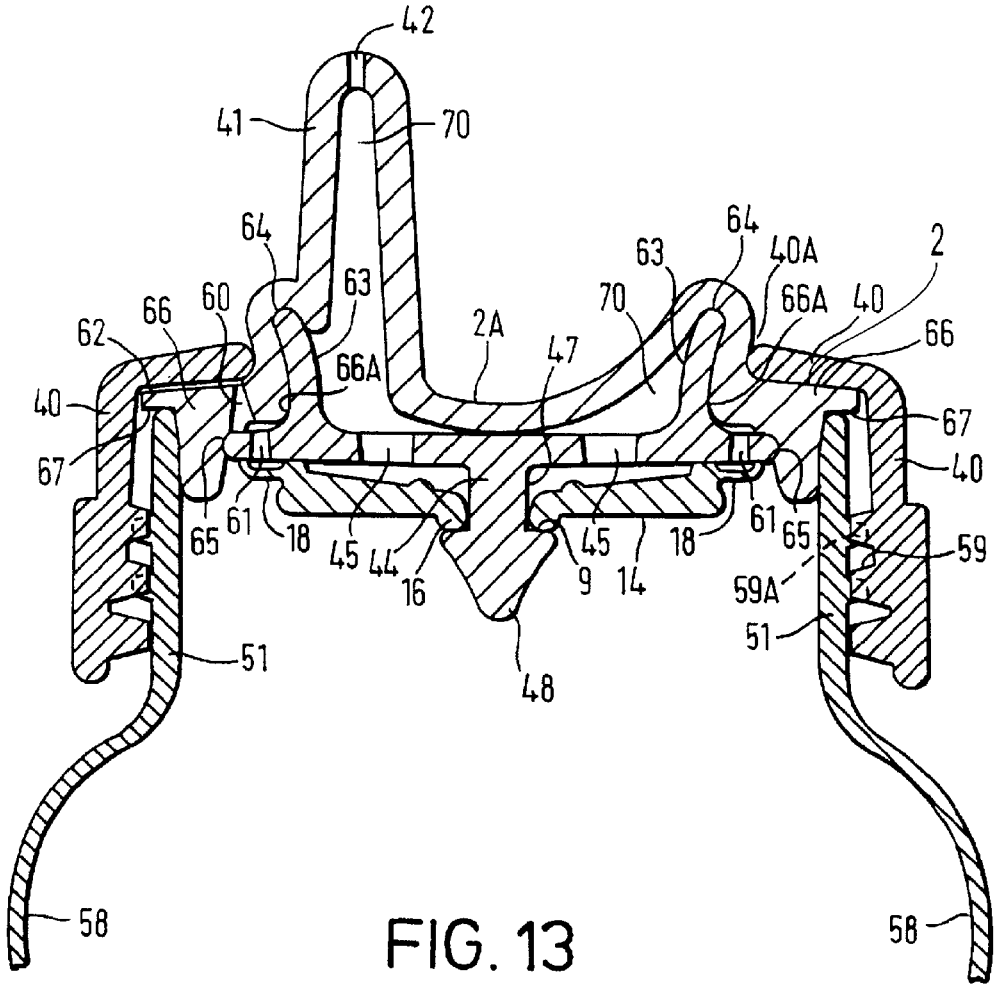
FIG. 13 is a cross section through yet another embodiment.

The embodiment shown in FIG. 13 is similar to those shown in FIGS. 10 and 11 except that the closure assembly is vented to atmosphere in a slightly different way.

Referring now to FIG. 13 in which the same reference numerals are used for the same or similar parts to those used in other Figures of the drawings, there is shown a lid 2 with a drinking spout 41 extending upwardly therefrom. The lid 2 is releasably attached to neck 51 of a drinking vessel 58 such as a feeding bottle by means of screw cap 40 which has internal threads 59 which cooperate with threads 59A on the neck 51 in known manner. The spout 41 has a hole 42 therein to allow the passage of liquid therethrough.

The screwcap 40 has a central aperture 40A formed in it through which lid 2 and spout 41 protrude. The lid 2 has a laterally extending annular flange 66 around its base with an annular groove 65 formed around the inside surface thereof and an annular rebate 67 around its external edge. The lid 2 is also shaped to include a further internal annular recess 64 as illustrated for reasons to be explained hereafter. It should be noted that the flange 66 includes a tapered breather hole 60 extending through it, the top surface of the flange having one or more recesses 62 therein in communication with the hole 60.

The screwcap 40 engages with the flange 66 to sandwich it between the undersurface thereof and the upper rim of the neck 51 as illustrated, the neck portion of the drinking vessel 58 locating in the annular rebate 67.

A rigid but resilient moulded plastics insert 44 is removably mounted in the base of the lid 2 due to the engagement of its periphery in annular recess 65 formed on the inside surface of the lid 2. The insert 44 also has an outwardly flared annular upstanding flange 63 adjacent its periphery. The insert 44 is fitted in the lid 2 by pushing it into the open bottom thereof as a result of which the annular flange 63 flexes slightly inwardly as it passes internal edge 66A of flange 66 until it locates in the recess 64 in the lid. Holes 45 in its central region allow the passage of liquid therethrough. The insert 44 has upstanding central spigot 47 with an enlarged head 48 at its free end with annular seat 9 thereon. One or more breather holes 61 are provided outside is the upstanding flange 63 adjacent the periphery of the insert 44.

The central region 2A of the lid 2 can be concave as illustrated. The reason for this is that, in use, internal volume 70 above the insert 44 can still have residual liquid left in it after a user has stopped sucking on the spout 41 and the diaphragm 14 has closed. This residual liquid can then leak out through hole 42 which is undesirable so it is advantageous to keep this volume 70 to a minimum.

A diaphragm 14 shaped as illustrated and including a primary sealing portion in the form of an annular rib 16 around a central hole and a secondary sealing portion in the form of lateral flap 18 is fitted on the spigot 47 so that the annular rib 16 engages the seat 9 on the enlarged head 48 and the lateral flap 18 covers the breather holes 18. The diaphragm 14 is mounted on the spigot 47 in the same manner as has been described with reference to the other embodiments so that it assumes the illustrated concave configuration whereby the annular rib 16 makes a fluidtight seal with the seat 9 as does the lateral flap 18 with the breather holes 61.

The operation of the illustrated closure assembly is much the same as has already been described with reference to the earlier embodiments in that when a user sucks on the spout 41, a negative pressure is created in volume 70 inside the spout so the annular rib 16 is lifted away from the seat 9 on the enlarged head 48 of the insert 44 and liquid can flow from the interior of the drinking vessel 58, past the diaphragm 14, through the holes 45 in the insert 44, through the spout 41 and out of the opening 42 therein. At the same time, the flap 18 at the periphery of the diaphragm 14 is deflected away from the breather holes 61 due to the negative pressure created in the drinking 15 vessel 58 as a result of liquid being sucked out of it so external air will enter the vessel 58 through the recess 62, breather hole 60 and holes 61 in the insert 44 to equalise the internal and external pressure and thus the pressure across the diaphragm. As soon as the user stops sucking, the diaphragm 14 will re-locate on the seat 9 and the lateral flap 18 will re-locate over the breather holes 61 so no further liquid can flow past the diaphragm 44.

From the foregoing, it will be appreciated that the present invention provides a simple and effective valve system for a drinking container which is easy to manufacture, install and dismantle for cleaning purposes and therefore one which provides substantial advantages over prior art systems. The preferred diaphragm design has the advantage that it can provide two valving functions in a single component, the first function allowing liquid to flow past the valve when a negative pressure is applied thereto to permit a user to drink from the container and the second function allowing venting whereby external air is allowed to enter the container to equalise the internal and external pressures.

What is claimed is:

1. A closure assembly for fitting to an open ended drinking vessel comprising a lid with a drinking spout extending therefrom through which liquid can flow when a user sucks on said spout, a flexible resilient diaphragm retained by mounting means on the lid to normally prevent liquid flow through the spout, said diaphragm having a primary sealing portion which cooperates with a seat to make a fluidtight seal therewith, the diaphragm also having a secondary sealing portion which normally covers a breather hole to make a fluidtight seal therewith, the arrangement being such that when a user sucks on the spout, the primary sealing surface is deflected away from the seat to permit liquid flow and the secondary sealing portion no longer makes a fluidtight seal with the breather hole so air can pass therethrough to equalise the pressure across the diaphragm.

2. A closure assembly as claimed in claim 1 wherein the diaphragm has an aperture in the centre thereof.

3. A closure assembly as claimed in claim 2 wherein the primary sealing portion is an annular bead around said central aperture on one face of the diaphragm.

4. A closure assembly as claimed in claim 1 wherein the mounting means are provided adjacent the entrance to the spout.

5. A closure assembly as claimed in claim 4 wherein said mounting means is a post protruding from the entrance to the spout and the seat is an annular surface thereon.

6. A closure assembly as claimed in claim 5 wherein the post has an enlarged head with an undercut surface which provides the annular sealing surface at one end of the post.

7. A closure assembly as claimed in claim 1 wherein the diaphragm is disc shaped.

8. A closure assembly as claimed in claim 7 wherein the diaphragm has a central pillar extending therefrom with an enlarged head at its free end having the primary sealing portion thereon which engages the seat.

9. A closure assembly as claimed in claim 8 wherein the diaphragm has at least one hole therein for the passage of liquid therethrough.

10. A closure assembly as claimed in claim 8 or claim 9 wherein the primary sealing portion is an annular bead which extends from the enlarged head towards the diaphragm.

11. A closure assembly as claimed in claim 10 wherein the spout has an entrance which is closed by a wall with an aperture therein, said aperture providing the mounting means which receives the enlarged head of the diaphragm so that the annular bead contacts said wall to make a fluidtight seal therewith.

12. A closure assembly as claimed in claim 11 wherein gripping means are provided on the diaphragm to assist in its removal from the aperture in said wall.

13. A closure assembly as claimed in claim 7 wherein the diaphragm has an upstanding annular wall around its periphery extending from its opposite face.

14. A closure assembly as claimed in claim 13 wherein the secondary sealing portion is an annular flap which extends laterally outwardly from the upstanding wall and is inclined at an acute angle relative thereto.

15. A closure assembly as claimed in claim 5 or claim 6 wherein the post is a push-fit in the drinking outlet and has gripping means thereon to assist in its removal from the lid.

16. A closure assembly as claimed in claim 1 wherein the diaphragm is moulded from silicon rubber.

17. A closure assembly as claimed in claim 1 wherein the diaphragm becomes concave when mounted on the lid so that the primary sealing surface is normally biased into contact with the seat.

18. A closure assembly as claimed in claim 1 wherein the spout has an open end and the mounting means and breather hole are provided on an insert fitted to the spout to close the open end thereof.

19. A closure assembly as claimed in claim 18 wherein the insert has at least one hole therein to allow the passage of liquid therethrough.

20. A closure assembly as claimed in claim 18 or claim 19 wherein the mounting means is a post extending from the insert having an enlarged head with an undercut surface which provides the seat to cooperate with the primary sealing portion of the diaphragm.

21. A closure assembly as claimed in claims 18 or 19 wherein the insert has an upstanding projection thereon with a breather hole therethrough, said projection being adapted to locate in a corresponding hole in the lid.

22. A closure assembly as claimed in claims 18 or 19 wherein the insert has means thereon for releasably attaching said insert to the closure assembly.

23. A closure assembly as claimed in claim 13 or claim 14 wherein the diaphragm has a second upstanding lip or wall with an annular flap extending laterally therefrom provided around its periphery, said second wall and flap being a mirror image of said first wall and flap to provide a double sided diaphragm which is H-shaped in cross section.

24. A closure assembly as claimed in claim 1 wherein the breather hole is provided on the lid.

* * * * *